US006240564B1

(12) United States Patent
Te Kanawa

(10) Patent No.: US 6,240,564 B1
(45) Date of Patent: Jun. 5, 2001

(54) GARMENTS

(76) Inventor: Kohi Te Kanawa, P.O. Box 19, Waitomo 2566 (NZ)

( * ) Notice: Subject to any disclaimer, the term of this patent is extended or adjusted under 35 U.S.C. 154(b) by 0 days.

(21) Appl. No.: 09/462,327

(22) PCT Filed: Jul. 7, 1998

(86) PCT No.: PCT/NZ98/00095

§ 371 Date: Mar. 6, 2000

§ 102(e) Date: Mar. 6, 2000

(87) PCT Pub. No.: WO99/02052

PCT Pub. Date: Jan. 21, 1999

(30) Foreign Application Priority Data

Jul. 8, 1997 (NZ) ..... 32879

(51) Int. Cl.[7] ..... A41D 1/04
(52) U.S. Cl. ..... 2/115; 2/69
(58) Field of Search ..... 2/69, 108, 102, 2/106, 105, 114, 113, 115, 93, 85, 94, 88, 92, 271, 695; 280/801 R; 297/484, 465, 467, 464, 468; 128/869, 870, 873, 875, 876, 137; 119/846.96; 441/80, 106, 108; 224/157, 158, 911, 901; 54/37.1, 44.1, 46, 47, 49

(56) References Cited

U.S. PATENT DOCUMENTS

| | | | | |
|---|---|---|---|---|
| 3,533,107 | * | 10/1970 | Raneri et al. | 2/69 |
| 4,172,292 | * | 10/1979 | Horton | 2/102 |
| 4,302,849 | * | 12/1981 | Margetson | 2/115 |
| 4,429,419 | * | 2/1984 | Snyder | 2/102 |
| 4,449,253 | | 5/1984 | Hettinger . | |
| 4,625,334 | * | 12/1986 | Proffer | 2/1 |
| 4,762,257 | | 8/1988 | Spillers . | |
| 5,065,773 | | 11/1991 | Jackson . | |
| 5,369,804 | | 12/1994 | Metcalf . | |
| 5,544,363 | * | 8/1996 | McCue et al. | 2/102 |
| 5,619,751 | * | 4/1997 | Ray et al. | 2/102 |
| 5,832,536 | * | 11/1998 | Kramer | 2/69 |

* cited by examiner

*Primary Examiner*—Gloria M. Hale
(74) *Attorney, Agent, or Firm*—Stentina Brunda Garred & Brucker

(57) ABSTRACT

This invention relates to a garment for use in the game of Rugby Union. It is primarily to be worn by a member of the tight five. The garment has handles positioned on the garment, oriented in locations so as to be gripped by another member of the forwards in scrummage play, to aid in the support of the scrummage formation.

13 Claims, 6 Drawing Sheets

GARMENTS

TECHNICAL FIELD

This invention relates to improvements in and relating to garments.

In particular this invention relates to improvements in rugby jerseys. The reference to rugby jerseys should not be seen to be limiting scope of the present invention, as the improvements in the present invention may apply to other garments as the situation may demand.

BACKGROUND ART

Rugby is an extremely popular game in many parts of the world. The game demands a lot of physical contact, and has many facets of play.

The group of players known as the forwards, commonly wearing numbers 1–8, are particularly involved in areas of play known as scrummaging, line outs, mauls and rucks, as well as forms of running play.

The scrummage (the scrum) is a facet of set play in which the forwards, the "tight" 5 in particular, must bind together in a formation, facing the oppositions forwards in the same formation, the two forward packs coming together in an effort to push the other of the ball and gain possession.

The nature of the serum is such that the player's body positions are very low in a crouch position with their heads and backs being horizontal. As is the current practice, the tight 5, that is, the two props, the hooker and two locks, bind together by securing a section of their teammate's rugby jersey with their hands in a convenient place, and pulling it tight.

It is important that the binding is strong, as should one of the tight 5 lose their grip on the jersey they are holding onto, the scrum may become unbound, lose collective pushing power, or the scrum may collapse.

It is the latter situation that is fraught with the most danger. The danger arises particularly in the front row where, should the scrum collapse, the front row players heads are inevitably forced into the ground.

This has resulted in many injuries to players, the most severe being broken necks causing permanent paralysis, or even death. The hooker is in a particularly vulnerable position as he or she has no way of reducing the force against the ground due to both of the hooker's arms being positioned on the backs of the props.

In today's play with the modified rules, the flankers, namely number 6 and number 7 jerseys, are involved more in the pushing force of the scrum. This is because previously the flankers merely had to be in contact with the scrum resulting in the flankers merely keeping their hands on the scrum, waiting for the ball to pop out the side. As it is now required for the ball to emerge from the scrum behind the lock's feet, it is more advantageous that the flankers bind properly and aid in the pushing of the scrum. Consequently their grip must be also be firm.

The main reason why players lose grip of the jersey is that it becomes too much of a strain for their hands and wrists to hold onto a section of bare jersey while the scrum is moving about. This could be due to the range of gripping strength of the players, the playing conditions, it being harder to grip when it is cold or wet or both, or the jersey may be pulled too tight to obtain a quality hold.

During facets of play such as rucks and mauls, it is advantageous for a team to be well bound, and low in body position, in order to push the other team's forwards closer to their goal line. Again, the binding is usually obtained by securing a teammate's jersey. The tighter and more secure the grip, the more effective the body position and safer the facet of play.

What would be of great advantage is a rugby jersey that enables faster, easier, and a stronger binding to other players, and that reduces the risk of players becoming unbound during facets of play in which they are required to be bound or in which it is safer to be bound.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a garment characterised in that it has attached a holding means for aiding the securing of the garment by a person, wherein the holding means is attached to the garment in such a way that the forces resulting from the grasping of the said garment are distributed throughout the garment.

Reference to the garment shall now be made with reference to a sports jersey, in particular a sports jersey worn during a rugby match. The reference to the garment as a rugby jersey should not be seen to be limiting the scope of the present inventions manufacture or use, as the principles of the present invention may be applied to other garments in different situations.

In a preferred embodiment the holding means may consist of a length or lengths of a strap of material fixably attached to the rugby jersey, said holding means being fixably attached to reinforcing material. The said reinforcing material may be fixably attached to the rugby jersey. This may be hereafter referred to as the first configuration.

The holding means shall be hereafter referred to as straps. The use of the term straps to refer to the holding means should not be seen to be limiting the scope of the present inventions manufacture or use.

The advantage that this configuration over the prior art is that players may bind to the rugby jersey with a greatly increased grip strength. This means the danger of scrum collapse and the risk: of associated injuries are greatly reduced.

The reinforcing material allows forces on the rugby jersey to be distributed evenly. This results in the advantage that the strap is able to bear a large amount of force and reduces the risk of tearing occurring in the rugby jersey material.

In some preferred embodiments, the portion of the straps that the players bind to may be orientated substantially vertically or horizontally with reference to the orientation of the jersey. The vertical or horizontal orientation of the portion of the straps that the player bind to should not be seen to be limiting the scope of the present inventions manufacture or use, as that portion may be orientated as the situation demands.

This portion shall be hereafter referred to as the "handle". This reference should not be seen as limiting the scope of the present inventions manufacture or use.

The advantage of having the handles substantially vertically or horizontal attached to the rugby jerseys, is that these orientations enable the players to bind directly onto the strap with greater ease, as the orientation of the strap is in the same plane in relation to the plane that the player's hands will encounter the strap.

In preferred embodiments, the handle may comprise a length of strap wound about a plastic tube along its axis.

This has the advantage of improving the ability of a person to secure the handle.

In another preferred embodiment, the reinforcing material may be attached to the inside of the rugby jersey. Attaching the reinforcing material in this fashion has the advantage of reducing the interference the reinforcing material may have on physical aspects of the game, and with the visual impact of the rugby jersey.

The attachment of the reinforcing means to the inside of the jersey should not be seen to be limiting the scope of the present inventions manufacture or use, as the reinforcing means may be attached in many convenient places on the jersey.

The attachment between the jersey and the reinforcing material may be permanent or semipermanent, whether or not the reinforcing means is positioned on the interior or exterior of the jersey.

In preferred embodiments, the reinforcing material may be made of the same material as the holding means.

In a further preferred embodiment, the holding device may be attached on the inside of the garment, along with the reinforcing means, accessible by an aperture in the jersey. This shall be hereafter referred to as the second configuration.

The second configuration has the advantage that the handles may be accessed for use during set play requiring binding, but the said handles will be out of reach of opposition players during running play. In this second configuration, the openings may preferably be substantially the same orientation as the handles.

This gives an advantage on enabling easy access to the straps.

The said opening may be closeable by a hook and pile system such as Velcro™. This should not be seen to be limiting the scope of the present inventions use or manufacture, as other methods of closing, for example domes, or buttons may be used.

Configuring the rugby jersey attachments in the way described in the second configuration should not be seen to be limiting the scope of the present invention's manufacture or use, as the concept of the present invention may be achieved through other configurations, as the situation may demand.

The holding means may be attached to the jersey in the first and second or any other configurations in a variety of ways. For example, the holding means may be attached to the reinforcing means by stitching, glue, a hook and pile system such as Velcro™, or some other form of adhesive substance. The attachment may be permanent or semipermanent.

In preferred embodiments however, the holding means may be stitched to the reinforcing means. The attachment of the holding means to the reinforcing means by stitching should not be seen to be limiting the scope of the present invention's manufacture or use as the holding means may be attached in a variety of ways as the situation may demand.

The advantage of stitching the holding means to the reinforcing means is that it provides a strong attachment, and ease of manufacture.

Similarly, the holding means may be attached to the reinforcing means in a variety of ways.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
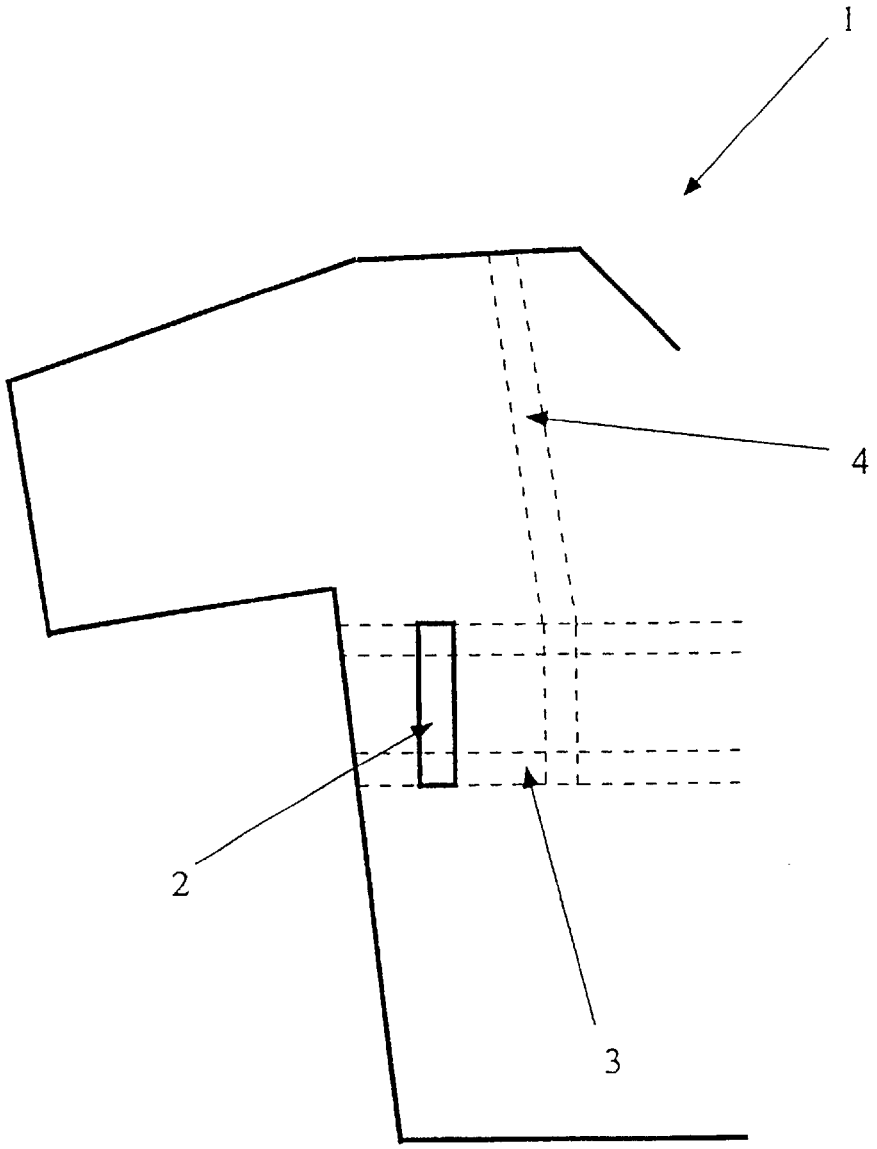
FIG. 1 is a view of a first preferred embodiment.

With reference to FIG. 1 there is provided a rugby jersey indicated by general arrow 1.

Attached to the rugby jersey there is a securing means including a handle 2 and a reinforcing means 3. The handle 2 is attached to the outside of the jersey 1, and attached through the jersey fabric to reinforcing means 3

The reinforcing means 3 is accordingly attached to the inside of the jersey fabric. Included in the reinforcing means 3 is a shoulder strap section 4.

Figure 2:
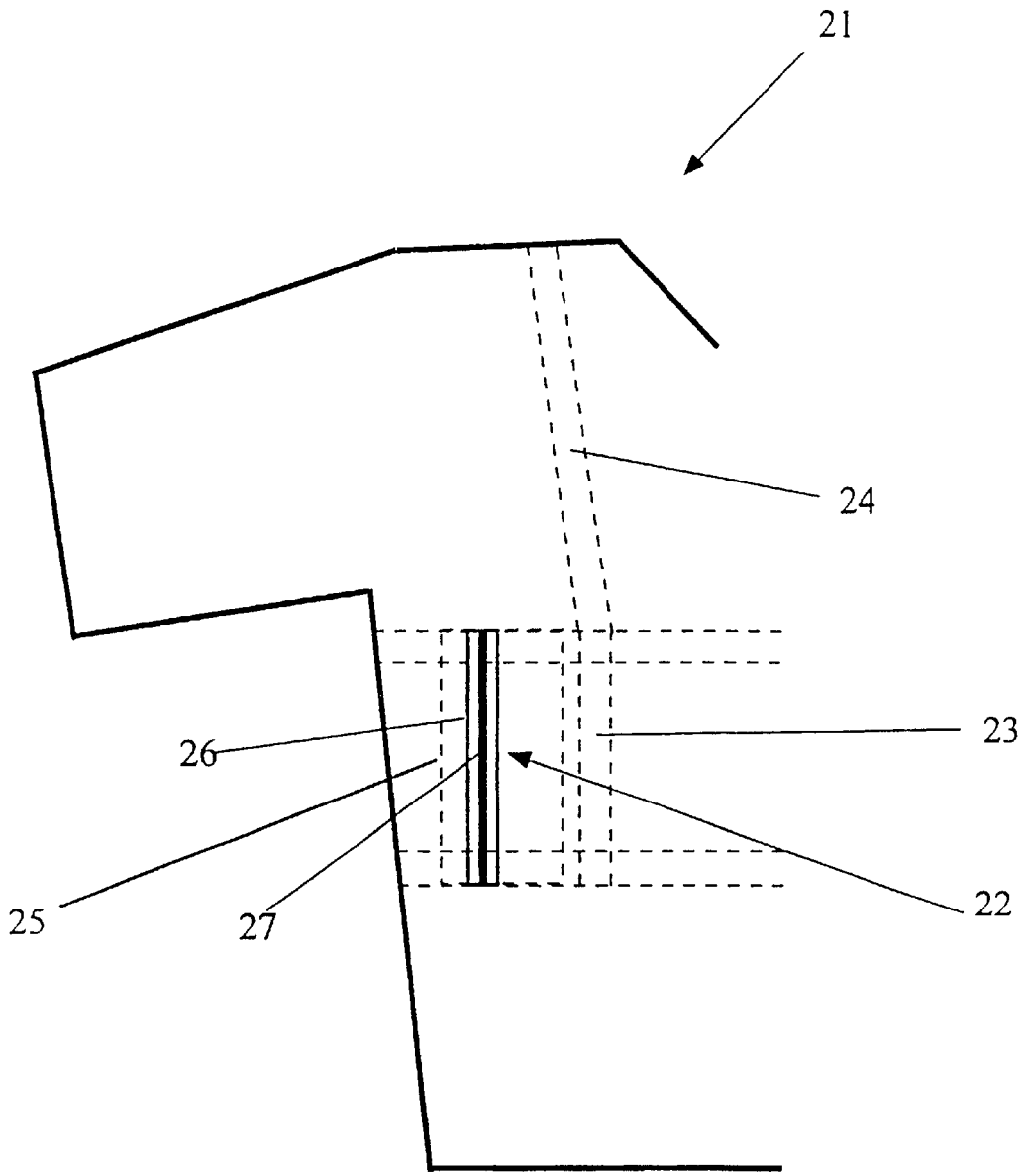
FIG. 2 is a view of a second preferred embodiment including an accessible recess.

With reference to FIG. 2 there is shown a rugby jersey 21. The securing means 22 includes a substantially longitudinal portion of inner fabric 25. Inner fabric 25 is axially bounded and secured by fabric 27. Fabric 27 may be another piece of fabric or may be part of the fabric of the rugby jersey 21.

Handle 22 is housed in recess 26.

The rugby jersey 21 includes shoulder strap 24 and reinforcing means 23, both of which are attached to the jersey, and securing means 22.

Figure 3:
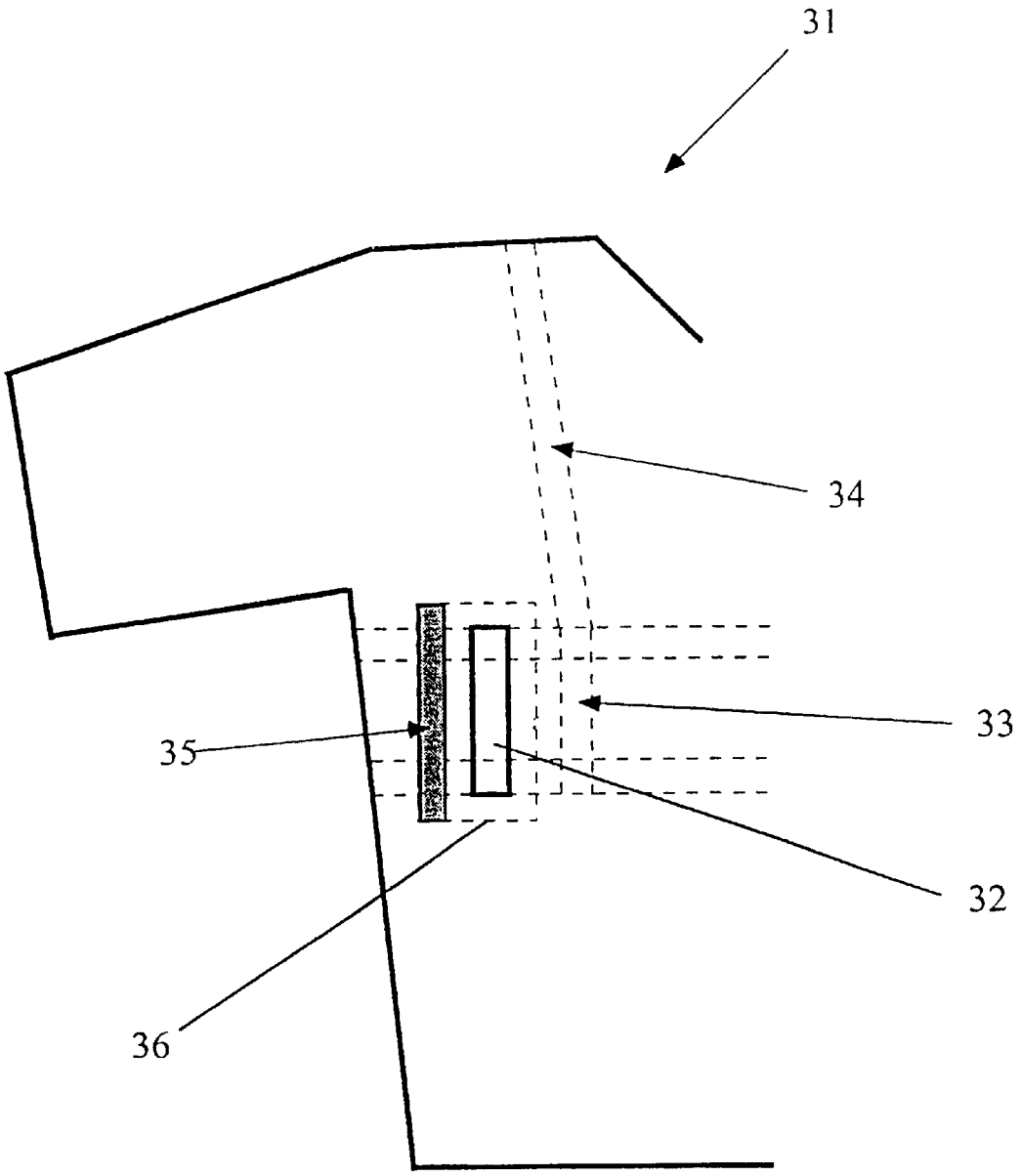
FIG. 3 is a view of a third preferred embodiment including a closeable recess.

With reference to FIG. 3 there is shown a further preferred embodiment of the present invention shown by general arrow 31. Securing means 32 is housed in a recess 36. Recess 36 is reusably closeable by sealing means 35. Sealing means 35 may be a hook and pile system such as Velcro™.

Rugby jersey 31 also includes shoulder strap 34 and reinforcing means 33 which are stitched to the jersey and to the recess 36 and holding means 32.

Figure 4:
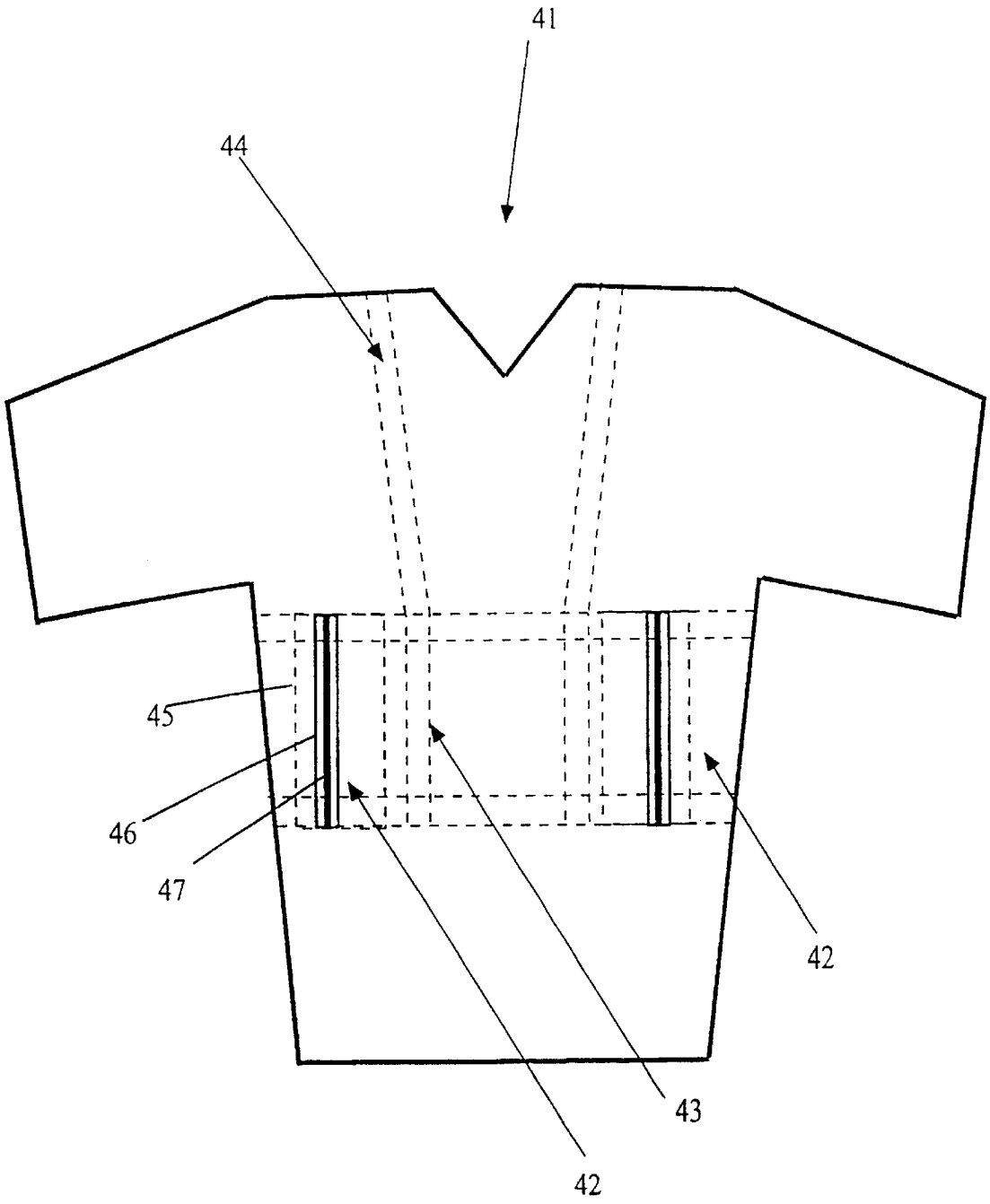
FIG. 4 is a front view of one possible configuration of the present invention.

With reference to FIG. 4 there is shown an example of a possible configuration of the present invention on a rugby jersey shown by general arrow 41.

The securing means 42 is of substantially the same configuration as the preferred embodiment shown in FIG. 2. It includes inner fabric 47 axially bounded by further fabric 46. Further fabric 46 and inner strap 47 are housed in recess 45.

Recess 45, fabric 46 and inner strap 47 are stitchably attached to the jersey 41 and reinforcing means 43. The rugby jersey 41 also includes shoulder strap 44. The rugby jersey 41 has a securing means 42 as described above positioned substantially either side of the chest area of the rugby jersey 41.

Figure 5:
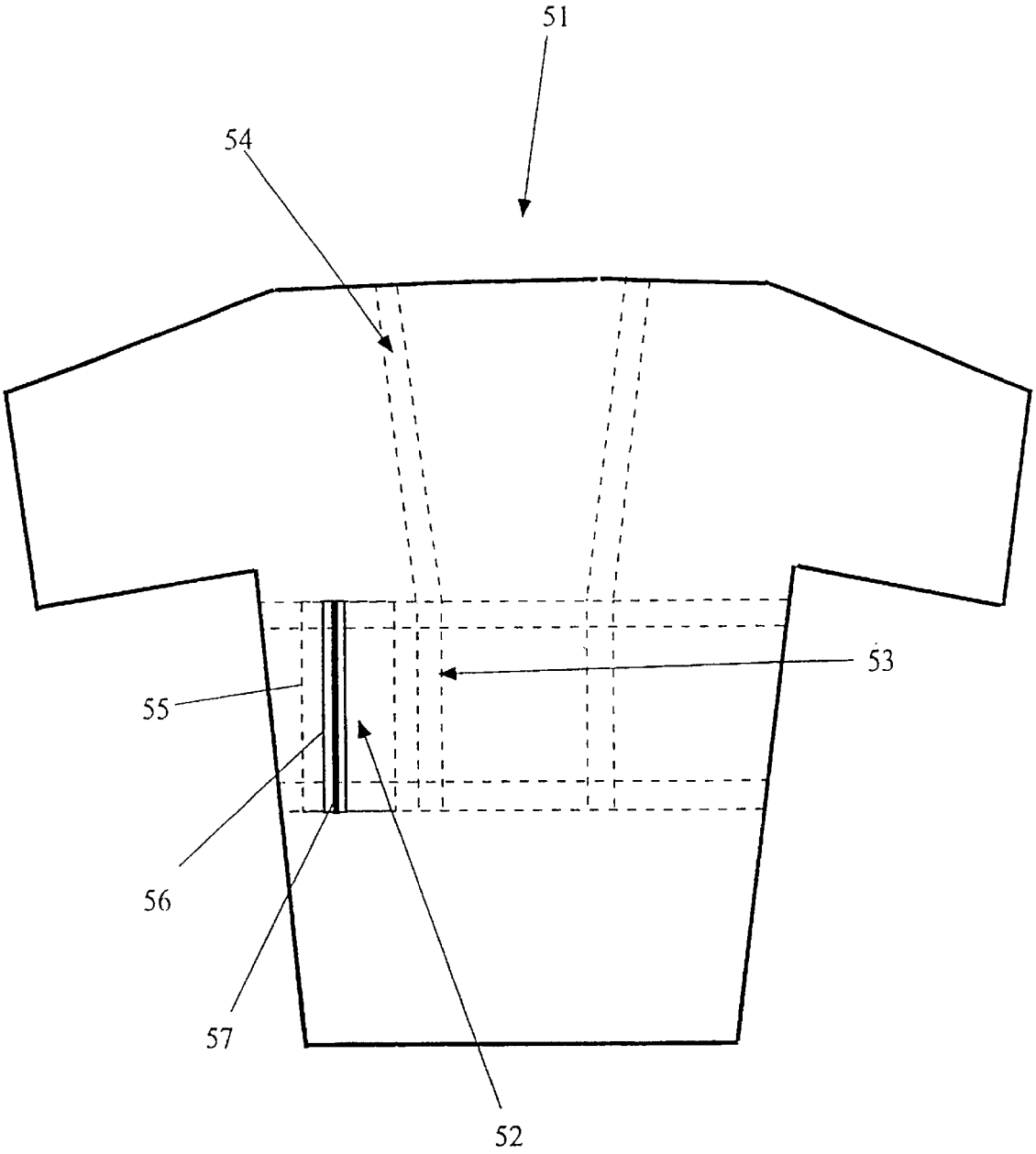
FIG. 5 is a rear view of a further possible configuration of the present invention.

With reference to FIG. 5 there is shown a rear view of a rugby jersey shown by general arrow 51. The securing means 52 is positioned substantially about the shoulder blade area of the rugby jersey.

The configuration of the holding means 52 is shown to be substantially the same as the example in FIG. 2. Securing means 52 includes inner fabric 57 axially bounded by a further fabric 56, both being housed in recess 55. 55, 56 and 57 are stitched to reinforcing means 53 and the fabric of jersey 51.

Jersey 51 also includes shoulder straps 54 which are stitched to the rugby jersey 51.

Figure 6:
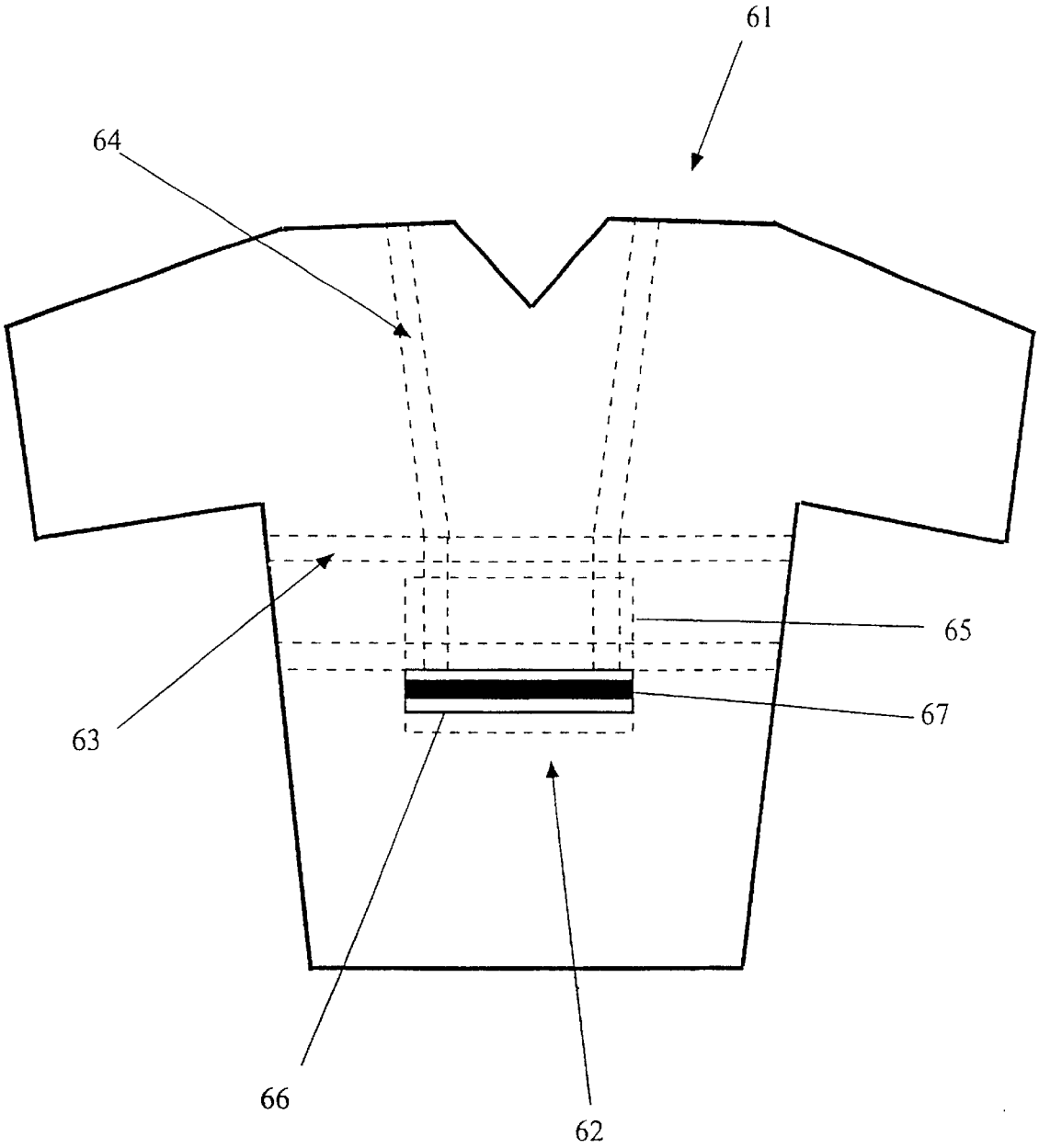
FIG. 6 shows a front view of a further possible configuration of the present invention.

With reference to FIG. 6 there is shown a front view of a rugby jersey 61 whereby the securing means 62 is substantially horizontally orientated, and positioned substantially in the centre of the jersey 61.

Securing means 62 comprises substantially the same configuration as shown in FIG. 2. It includes an inner fabric 67, axially bounded by further fabric 66. 67 and 66 are housed in recess 65.

65, 66, and 67 are stitched to the reinforcing means 63 and the fabric of jersey 61.

Jersey 61 also includes shoulder strap 64 which is also stitched to the fabric of jersey 61.

Referring to all the drawings, holding means 2, 22, 32, 42, 52, and 62, provide a stronger binding means for rugby players, reducing the risk of injury due to scrum collapse, often caused by incorrect or insufficient binding by players to other players.

The holding means described in FIGS. 2 to 6, are accessible through apertures in the recess. Inner fabric 27, 47, 57, and 67, may be a piece of plastic tubing, axially bounded by the further fabrics 36, 46, 56, and 66. The recesses in FIGS. 2, 4, 5, and 6 may also include a sealing means as described above in FIG. 3.

Aspects of the present invention have been described by way of example only and it should be appreciated that modifications and additions may be made thereto without departing from the scope thereof as defined in the appended claims.

What I claim is:

1. A sports garment to be worn substantially on the upper body of a wearer, the sports garment including at least one handle for aiding the gripping of the garment by a person other than the wearer, the handle being oriented so that it is secured at each end thereof to the garment such that the handle does not overlap itself and is grippable by a member of a rugby scrum when that member is in a physical position to aid in the support of the rugby scrum, and the wearer is a member of the rugby scrum.

2. A sports garment as claimed in claim 1 wherein the handle is attached to the sports garment in such a way that forces applied to the sports garment resulting from the gripping of the handle are distributed throughout the sports garment.

3. A sports garment as claimed in claim 1 wherein the handle includes a strap of material.

4. A sports garment as claimed in claim 3 whereby the handle is fixedly attached to a reinforcing means.

5. A sports garment as claimed in claim 1 wherein the handle is located in a recess in the sports garment.

6. A sports garment as claimed in claim 5 wherein the recess is openable and closable.

7. A sports garment as claimed in claim 1 wherein the handle includes a strap of fabric wound along its length about a strip of heavier fabric.

8. A sports garment as claimed in claim 7 wherein the heavier fabric is a plastic tube.

9. A sports garment as claimed in claim 4 wherein the handle and the reinforcing means are stitched to the sports garment.

10. A sports garment as claimed in claim 4 wherein at least one of the handle and the reinforcing means are removably attached to the sports garment.

11. A sports garment as claimed in claim 4 wherein the reinforcing means is located on the interior of the sports garment.

12. A sports garment as claimed in claim 1 wherein the sports garment is a rugby jersey.

13. A sports garment as claimed in claim 1 wherein the sports garment has a breast area, and the handle comprises at least one substantially vertical handle on one side of the breast area of the sports garment.

* * * * *